US008114506B2

(12) United States Patent
Crawford, Jr.

(10) Patent No.: US 8,114,506 B2
(45) Date of Patent: Feb. 14, 2012

(54) HELICAL TEXTILE WITH UNIFORM THICKNESS

(75) Inventor: James A. Crawford, Jr., Rye, NH (US)

(73) Assignee: Crawford Textile Consulting, LLC, Portsmouth, NH (US)

( * ) Notice: Subject to any disclaimer, the term of this patent is extended or adjusted under 35 U.S.C. 154(b) by 621 days.

(21) Appl. No.: 12/198,311

(22) Filed: Aug. 26, 2008

(65) Prior Publication Data

US 2009/0239055 A1 Sep. 24, 2009

Related U.S. Application Data

(63) Continuation-in-part of application No. 12/050,789, filed on Mar. 18, 2008.

(51) Int. Cl.
*D04H 3/07* (2012.01)

(52) U.S. Cl. ..... 428/222; 428/66.2; 442/366

(58) Field of Classification Search ..... 428/66.2, 428/222; 442/366
See application file for complete search history.

(56) References Cited

U.S. PATENT DOCUMENTS

| | | | | |
|---|---|---|---|---|
| 2,412,843 | A | 12/1946 | Sparagen | |
| 3,293,720 | A | 12/1966 | Cumbers | |
| 3,881,522 | A | 5/1975 | Lewis et al. | |
| 3,950,583 | A | 4/1976 | Patin | |
| 4,510,657 | A | 4/1985 | Curinier et al. | |
| 4,686,134 | A | 8/1987 | Ono | |
| 4,907,323 | A | 3/1990 | Smith et al. | |
| 5,082,701 | A | 1/1992 | Craven et al. | |
| 5,222,866 | A | 6/1993 | LaBrouche et al. | |
| 5,326,410 | A | 7/1994 | Boyles | |
| 5,484,642 | A | 1/1996 | Bompard et al. | |
| 5,603,357 | A | 2/1997 | Schomaker et al. | |
| 5,795,835 | A | 8/1998 | Bruner et al. | |
| 5,952,075 | A * | 9/1999 | Clarke et al. | 428/66.2 |
| 6,009,605 | A | 1/2000 | Olry et al. | |
| 6,086,968 | A | 7/2000 | Horovitz | |
| 6,248,417 | B1 | 6/2001 | Ponsolle et al. | |
| 6,447,886 | B1 | 9/2002 | Mohamed et al. | |
| 6,491,779 | B1 | 12/2002 | Bryant | |
| 6,494,235 | B1 | 12/2002 | Bruyere et al. | |
| 6,676,442 | B2 | 1/2004 | Johnson et al. | |
| 6,684,404 | B2 | 2/2004 | Bachner, Jr. et al. | |
| 6,899,941 | B2 | 5/2005 | Goering et al. | |
| 2002/0050446 | A1 | 5/2002 | Antoniazzi | |
| 2003/0119391 | A1 | 6/2003 | Swallow et al. | |
| 2005/0235471 | A1 * | 10/2005 | Delecroix | 28/107 |

FOREIGN PATENT DOCUMENTS

EP 0245065 A2 11/1987

(Continued)

*Primary Examiner* — Andrew Piziali
(74) *Attorney, Agent, or Firm* — Mesmer & Deleault, PLLC

(57) ABSTRACT

A helical textile of uniform thickness having uniform radial weft fibers from a textile ID to a textile OD; and non-interlaced circumferential warp fiber bundles having equal width and height that increases from the textile ID to the textile OD, thereby forming a helical textile having a uniform thickness from textile ID to OD. Other embodiment includes non-interlaced circumferential warp fiber bundles having an equal cross section area, a height that increases from the textile ID to the textile OD, and a width that decreases from textile ID to textile OD. Yet another embodiment includes a helical textile of a uniform thickness having circumferential warp fibers; and more than one radial weft fiber bundles, each radial weft fiber bundle occupying a zone between two selected radial distances between the textile ID and OD, wherein the cross sectional areas of the radial weft fiber bundles increases from helical textile ID to OD.

2 Claims, 9 Drawing Sheets

FOREIGN PATENT DOCUMENTS

| | | | |
|---|---|---|---|
| EP | 1268406 | B1 | 2/2004 |
| GB | 798309 | | 7/1958 |
| WO | 9709476 | A2 | 3/1997 |
| WO | 9806570 | A1 | 2/1998 |
| WO | 0050676 | A1 | 8/2000 |
| WO | 0073177 | A1 | 12/2000 |
| WO | 0175778 | A1 | 10/2001 |

* cited by examiner

HELICAL TEXTILE WITH UNIFORM THICKNESS

This application is a continuation in part of U.S. patent application Ser. No. 12/050,789 filed Mar. 18, 2008.

BACKGROUND

1. Field of the Invention

The invention relates to helical textiles.

2. Description of the Related Art

One of the primary purposes of helical or spiral shaped material is to reinforce a composite material. Therefore, the fiber selection, fiber orientation and other features of the textile material must be considered to maximize the effectiveness of the textile material as a reinforcement to the final product.

Others have described woven helical fabrics, such as that disclosed in U.S. Pat. No. 5,222,866 that was issued to LaBrouche et al. on Jun. 29, 1993, and which is not admitted to being prior art by its mention in this Background section (the '866 patent). In the '866 patent the yarns in the warp (circumferential direction of the spiral) and yarns in the weft (radial direction of the spiral) are interlaced in the manner used with traditional weaving processes and typical weave designs, such as plain weave, satin weave, and basket weave.

One example is shown in FIG. 1. The interlacings produced in the weaving process are necessary to hold the fabric together, and result in a lack of straightness in the yarns in either or both of the warp or weft directions called crimp. Crimp is introduced at fiber interlacings as illustrated in 106*a* through 106*e* between warp yarns 102 and weft yarns 104. The crimp reduces the efficiency of the fibers to translate their properties to the ultimate composite structure or textile material.

Knitting processes can be divided into two categories: warp knitting and weft knitting. Weft knitting results in a textile structure where the yarns are interlocked to adjacent yarns resulting in very tortuous fiber paths. This does not allow for effective reinforcement for high performance composites.

What is needed, therefore, is a helical textile for reinforcing composite materials that does not crimp the fibers, but has uniform thickness, and process for making the same.

SUMMARY

The invention is a helical textile that does not have interlaced warp and weft fibers yet has uniform thickness for reinforcing composite materials. The invention is a warp knit helical textile having a repeating pattern of weft fibers of varying lengths such that the overall textile has a uniform thickness. The warp layers and weft layers are secured with non-reinforcing knitted stitches. The process of making the same includes a warp knitting machine modified to have conical take-up rolls and a means for inserting the repeating pattern of weft fibers of varying lengths. These and other features, advantages, and benefits of the present invention will become more apparent with reference to the appended drawings, description, and claims.

DRAWINGS

DESCRIPTION

The invention is a warp knit helical textile having a repeating pattern of weft fibers of varying lengths such that the overall textile has a substantially uniform thickness and more consistent warp to weft fiber distribution from ID to OD. Warp knitting uses manufacturing methods to orient the fibers in layers that are not interlaced. Rather, warp and weft fibers are constructed in discrete layers, one above the other.

Figure 1:
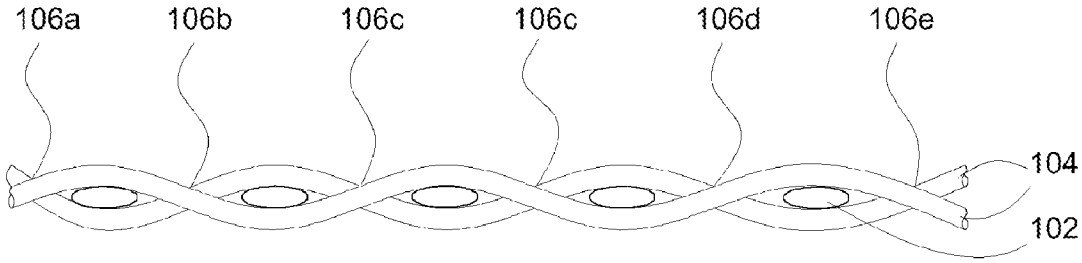
PRIOR ART Fig. 1
FIG. 1 is a side elevation of a textile of the prior art.
Figure 2:
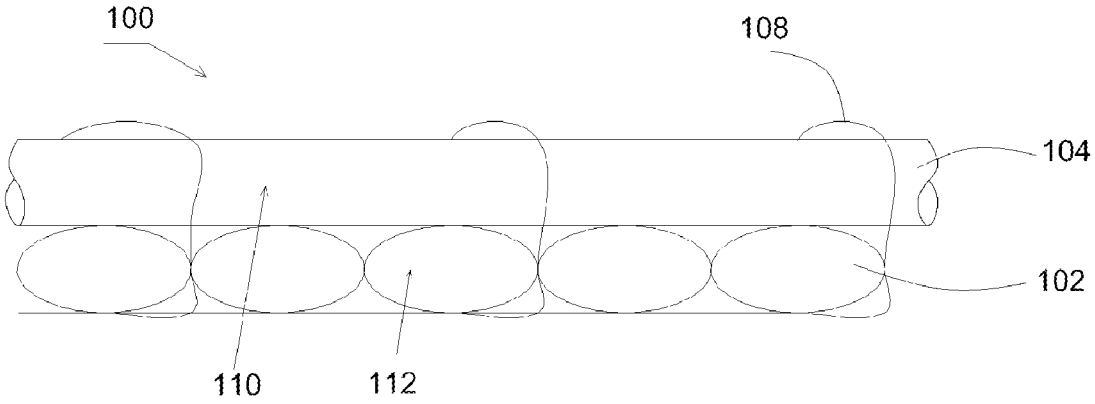
FIG. 2 is a side elevation of a textile according to the present invention.

The warp and weft fibers, in their respective layers, are straight, not crimped, and are parallel to adjacent fibers in the same layer. Turning to FIG. 2, warp fibers 102 and those next to it are shown in cross section, and are interpreted as coming out of the page. The warp fibers 102 are in the circumferential direction, and are circumferentially parallel to each other. The weft fibers 104 are in the radial direction, and are radially parallel to each other. Unlike the prior art, no interlacing between warp fiber layer and weft fiber layers are needed. The warp fibers 102 and weft fibers 104 are secured to each other or bound together with a third fiber direction. This third direction is inserted with knitted stitches 108. This third direction is not generally considered as a third reinforcing direction and is usually a non-reinforcing yarn type and in very low concentration compared to the warp and weft. The purpose of the knitted yarn is to hold the warp and weft layers together and to avoid the need to interlace the warp and weft. This third direction of yarn does not equate the resulting textile product to a three dimensional textile material since the resulting material described here is a single layer of knitted textile material. Contrast this to three dimensional weaving techniques that are used to manufacture multilayered textile materials.

The process of manufacturing the helical textile material utilizes modified warp knitting machinery. The modifications that are introduced are necessary to accommodate two issues:

the take-up means to introduce the helical shape, and the weave design to accommodate the varying geometry of the textile structure from the inside diameter ("ID") to the outside diameter ("OD") of the helical material produced. In the present invention it is desired that the resulting material have an as constant as practical ratio of warp to weft fibers from ID to OD. This requires that the weft end count at the OD be higher than at the ID.

Figure 3:
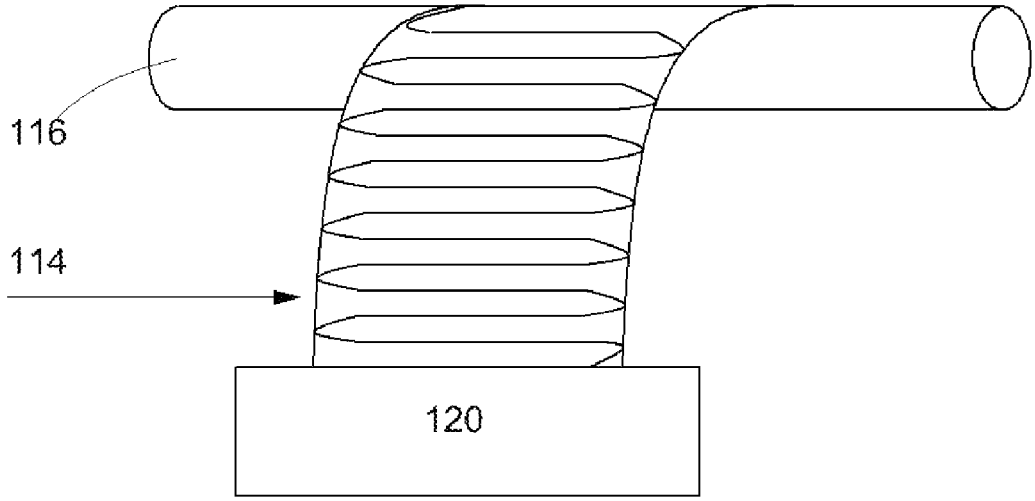
PRIOR ART Fig. 3
FIG. 3 is an orthogonal view of a take-up roll and textile of the prior art.

A warp knitting machine 120 of the prior art is shown in FIG. 3. The knitting machine 120 has a cylindrical take-up roll 116 and produces a straight woven textile 114. The warp knitting machine other than the take-up roll is shown as a black box in this drawing.

Figure 4:
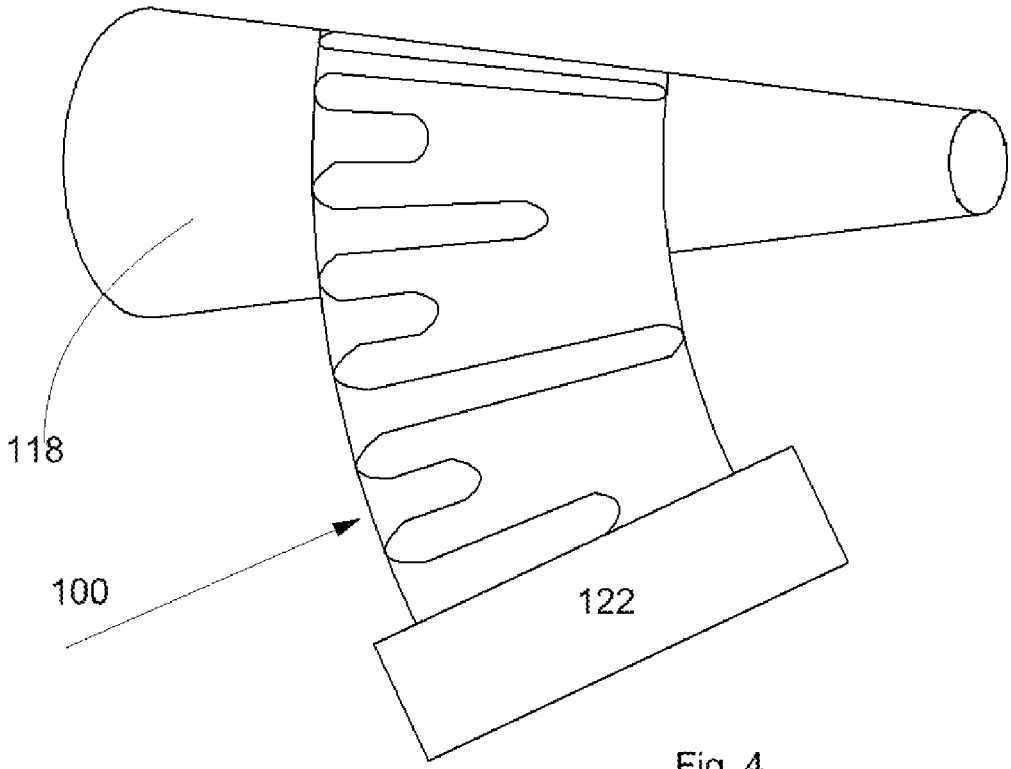
FIG. 4 is an orthogonal view of a take-up roll and textile of the present invention.

To make the helical textile 100 of the present invention, a warp knitting machine 122 is modified so that the cylindrical take-up rolls are replaced by conical take-up rolls 118 as shown in FIG. 4. The warp knitting machine is also shown as a black box in this drawing. The angle of the conical roll or rolls is designed to produce the desired ID and OD ratio of the resulting helical textile material 100. In this manner, the usual machine features necessary to adjust the take-up speed and such are maintained. A similar result is possible with a take-up mechanism that is a separate device from the knitting machine such that the material being knitted avoids the normal cylindrical take-up rolls. This separate device is controlled with mechanisms or electronic controls or both activated by features such as cams on the knitting machine.

Figure 5:
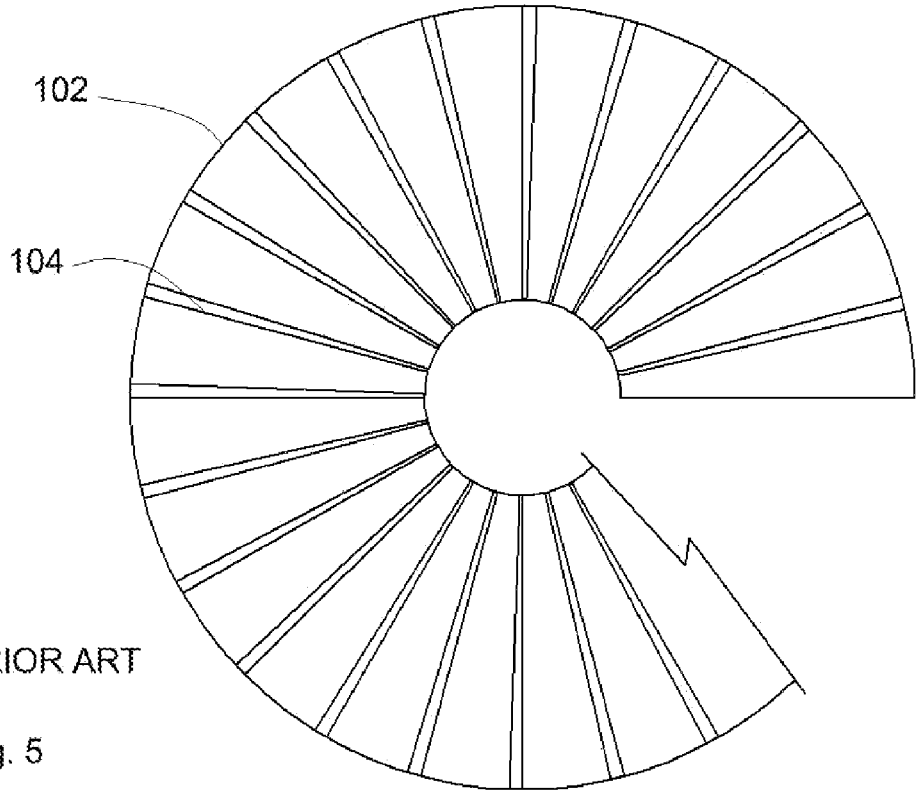
PRIOR ART Fig. 5
FIG. 5 is a plan view of a helical textile having a uniform length of weft fibers.

The ratio of warp to weft fibers will depend on the particular final application of the composite structure. Most applications envisioned will require an as uniform as practical ratio of warp to weft from ID to OD regardless of what that ratio is. This requires that not all weft (radial) fibers continue from OD to ID. For example, if we assume that the full width weft fiber length for a particular design was intended to be three inches, in a straight weave, all weft fibers would be three inches long. If in the same example but with a helical textile as shown in FIG. 5, and the weft fibers 104 are all three inches long, the spacing between adjacent weft fibers would be greater at the OD than at the ID. Therefore the weft fiber density near the ID would be greater than the OD and the thickness of the fabric near the ID would be greater than the OD. This would lead to non-uniform properties, which are undesirable.

Figure 6:
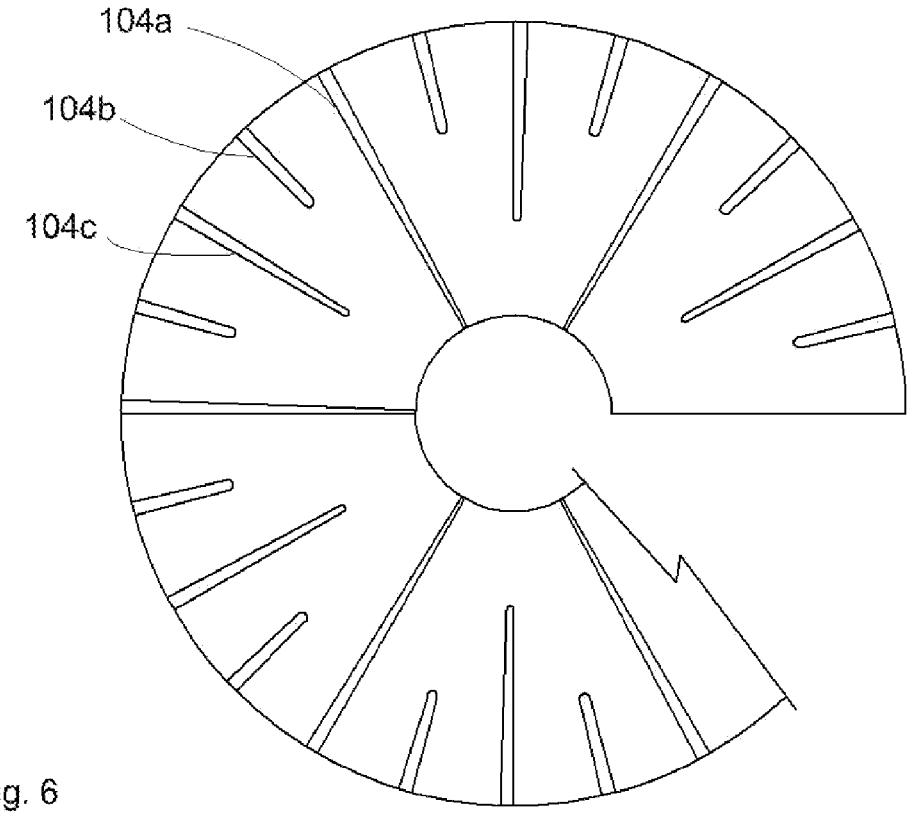
FIG. 6 is a plan view of a helical textile according to the present invention having uniform thickness.

This can be improved by introducing weft fibers 104 of less than three inch length, as shown in FIG. 6. The intent is to make the final textile material as uniform as practical from OD to ID. The weft fibers will have one end at the OD of the textile, and the other end will proceed to some predetermined location part way from the OD to ID and then terminate or return towards the OD. If individual weft fibers were inserted, then they would terminate. If a continuous weft fiber were inserted, then it would bend and return towards the OD.

In a helical textile, the repeating sequence of weft fiber insertions might be three inches 104*a*, one inch 104*b*, two inches 104*c*, one inch 104*b*, and finally three inches again 104*a*. This would allow more constant ratio of warp to weft from OD to ID. This also translates to a more constant thickness of the knitted material 100 across the width from ID to OD. It is understood that this is only an example of the different lengths of weft that can be used. A more uniform fabric can be made by increasing the number of different weft lengths, until it is no longer cost effective. The embodiment shown in FIG. 6 uses one weft insertion device.

Figure 7:
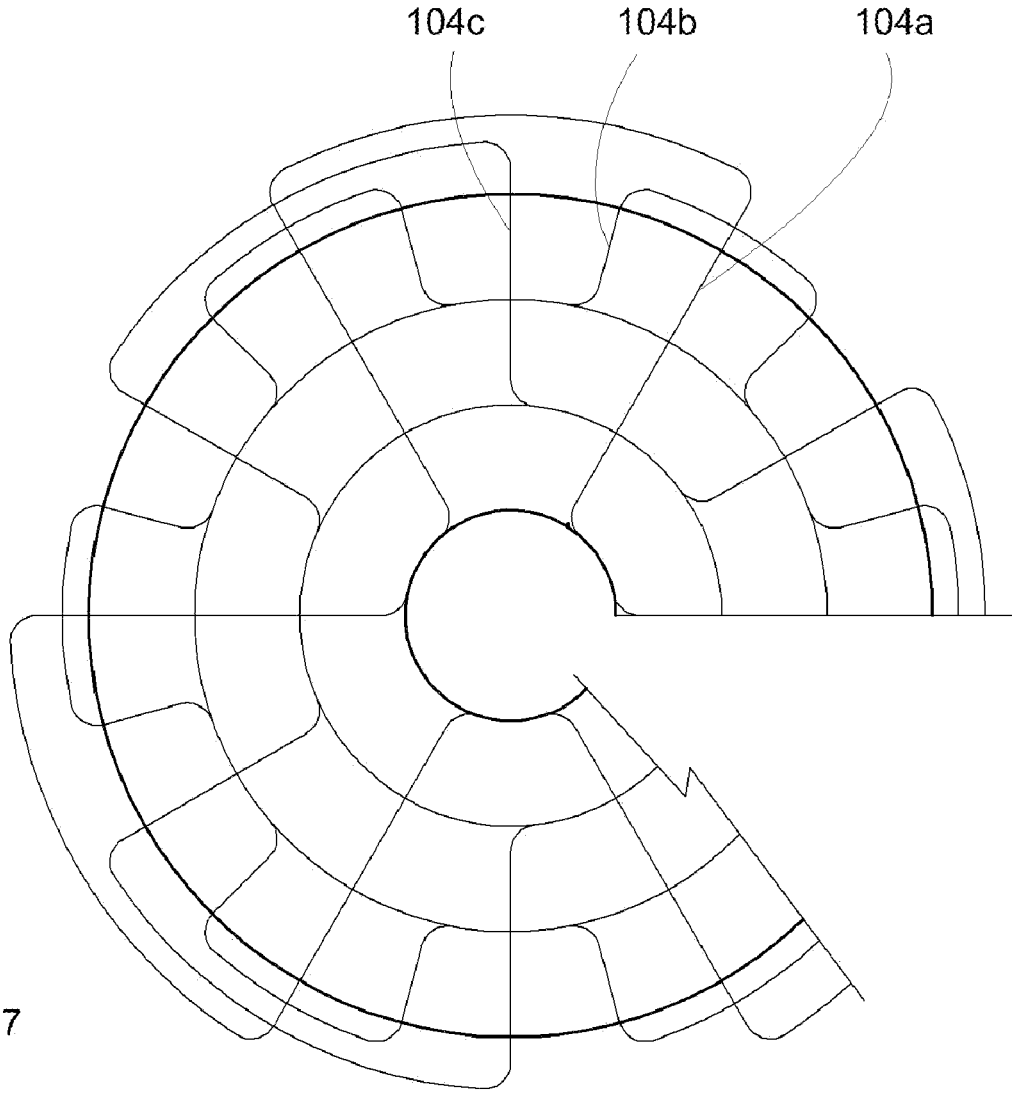
FIG. 7 is a plan view of another embodiment of a helical textile having a single weft yarn and is made using three weft insertion devices.

More complex patterns having a single weft yarn of different lengths instead of pairs is shown in FIG. 7. In this embodiment, three weft insertion devices are required.

The length of the weft insertion, also referred to as the shot or throw direction in knitting, can be controlled with cams, pins, knuckles, or electronically, depending on the style and age of the knitting machine used. The level of control generally available in all machines of this type is such that each weft insertion (shot or throw) can be tailored to be of different length. The combination, therefore, of variable length weft insertion and conical take-up will produce the material intended.

Figure 8:
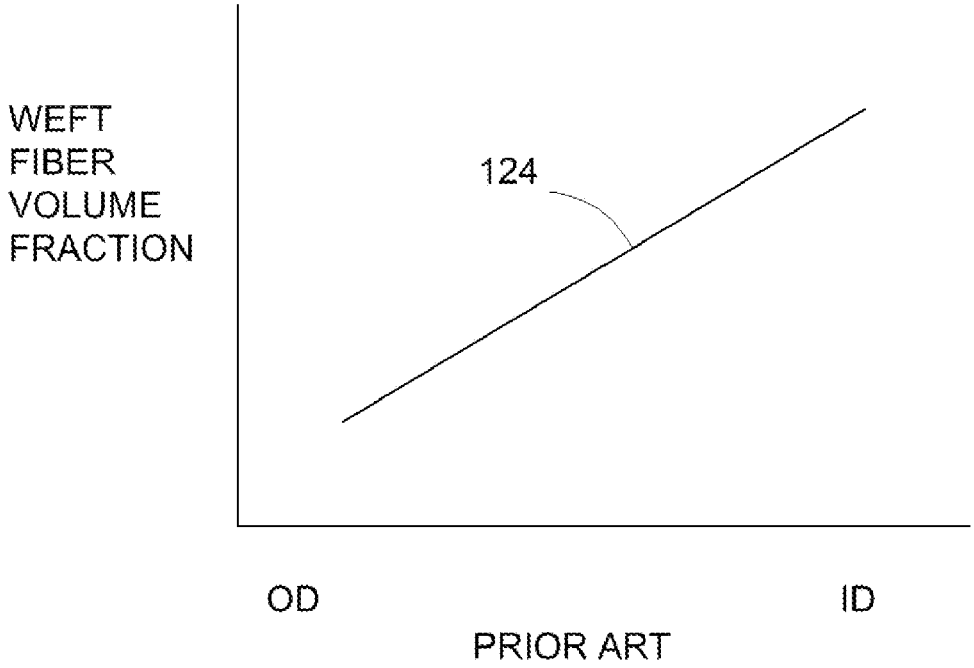
FIG. 8 is a graph of how the prior art weft volume fraction increases from OD to ID.
Figure 9:
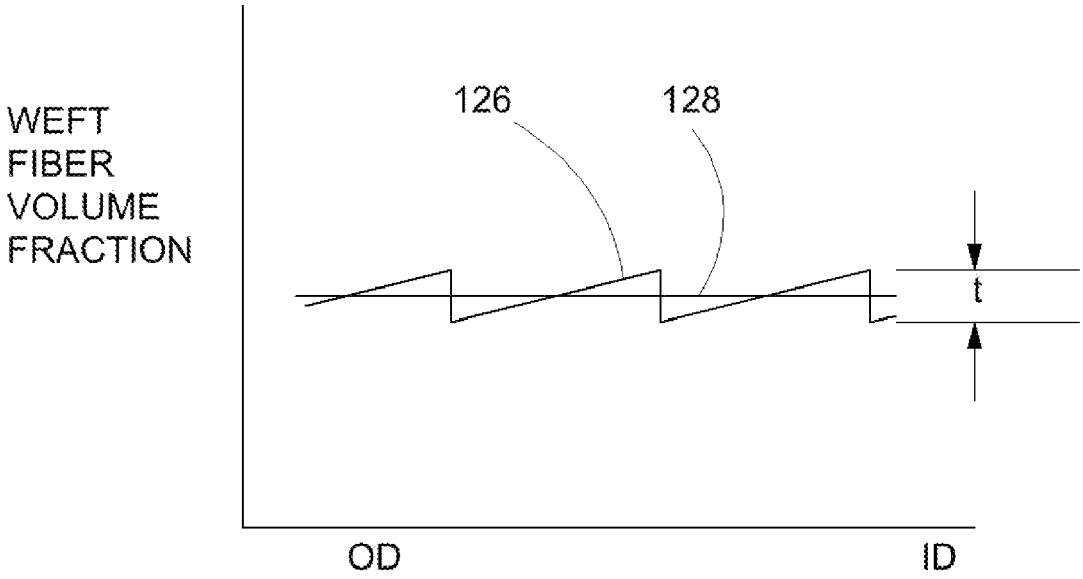
FIG. 9 is graph showing weft fiber volume fraction according to the present invention.

The helical fabric of the present invention has been said to have a "more constant" thickness than that of the prior art. The thickness of a single layer of fabric is not perfectly uniform or constant, but varies by the width of a weft fibers and insertion length. FIG. 8 is a graph that shows that the weft volume fraction 124 in the prior art increases from OD to ID. This increases the thickness. FIG. 9 shows that the weft volume fraction is more constant from the OD to the ID, and the thickness will be substantially more uniform.

FIG. 9 has a curve that represents weft fiber volume fraction from OD to ID 126. The curve 126 has three peaks that correspond to the use of weft fibers of three different lengths. The difference between the peaks and troughs is the thickness "t". The thickness "t" is not exactly the same as the thickness of a weft fiber, but it is related. The thickness "t" is also related to how closely the weft fibers are inserted together. The average thickness 128 is a flat line instead of a rising line like that in FIG. 8. As defined in the specification and claims, therefore, the term "substantially" uniform shall be construed to mean uniform to within the thickness "t".

Figure 10:
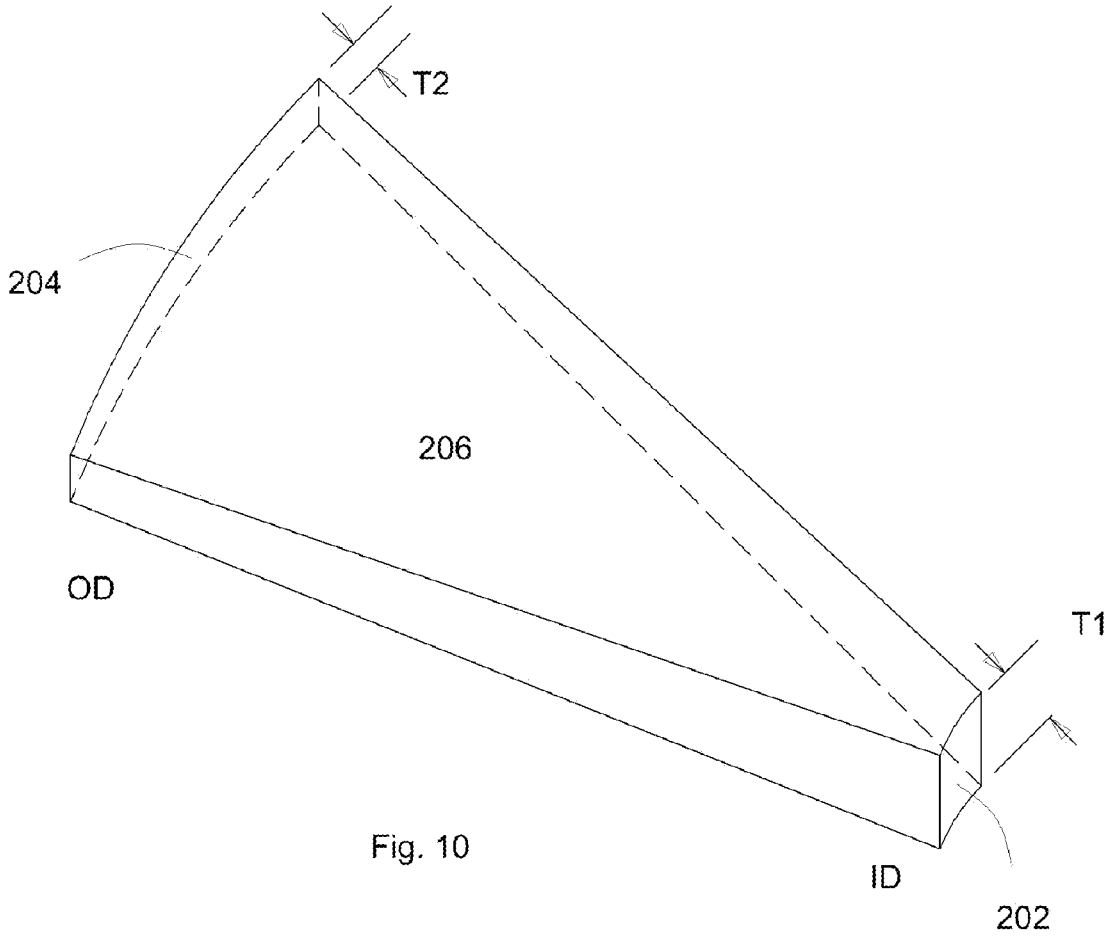
FIG. 10 is a perspective view of a weft section of non-uniform thickness.

There are other ways to form helical textiles having a substantially uniform thickness. FIG. 10 is a perspective view of a weft bundle 206 having uniform cross sectional area from the textile ID 202 to textile OD 204. The thickness T1 at the ID 202 is greater than the thickness T2 at the OD 204. The weft bundle width can be narrower at the ID 202 than at the OD 204 so that the cross sectional area can be constant along its length.

Figure 11:
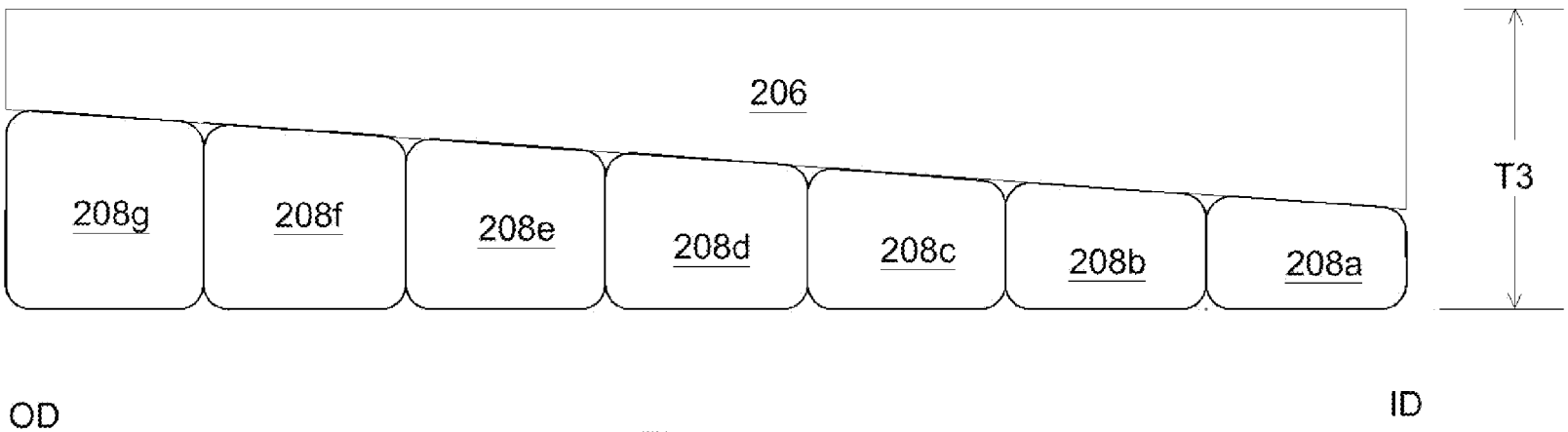
FIG. 11 is a cross section view of a textile having the weft section of FIG. 10 and warp fiber bundles having uniform width and varying height.

FIG. 11 is a cross sectional view of a helical textile showing the weft bundle 206 of FIG. 10 with progressively larger warp yarns 208*a* through 208*g* from ID to OD. Like the earlier embodiments, the warp and weft are not interlaced or crimped. The width of the warp bundles 208*a* through 208*g* are substantially constant, but their height increases from ID to OD. Combined with the properties of the weft 206, the overall height of the textile T3 remains substantially constant. The larger warp yarns have a larger cross sectional area as shown. This embodiment is very beneficial in that it permits the manufacturer to use yarn denier or filament counts that are already available.

Figure 12:
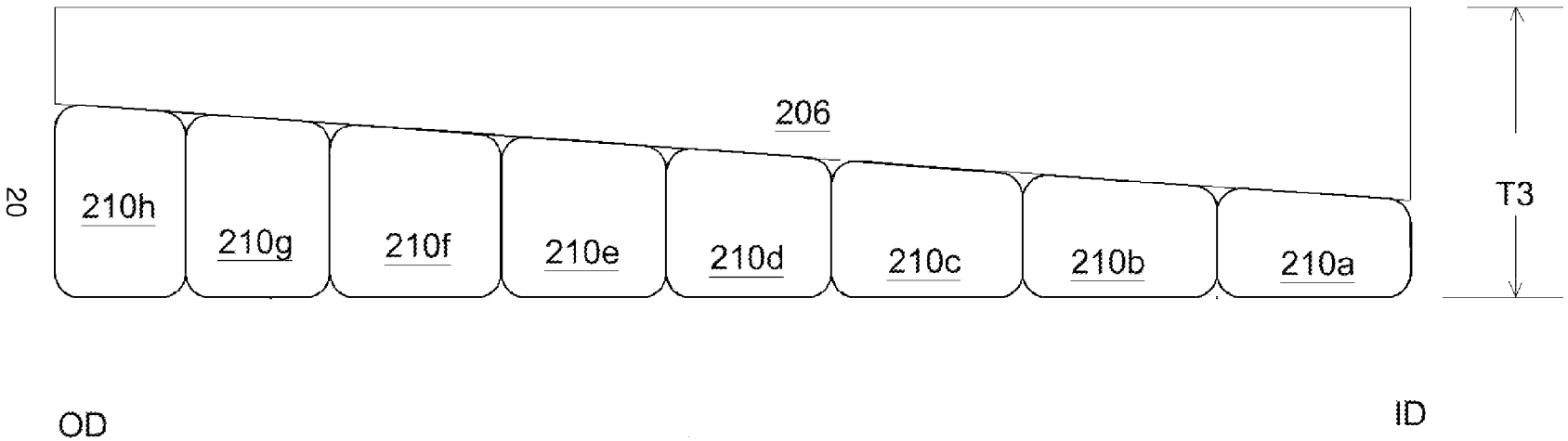
FIG. 12 is a cross section view of a textile having the weft section of FIG. 10 and warp fiber bundles having width varying inversely with height.

FIG. 12 is a cross sectional view similar to FIG. 11, except that the warp bundles 210*a* through 210*h* are the same size and have the same cross sectional area. They are merely spaced closer together toward the OD than the ID. This makes the width of the warp bundles 210*a* through 210*h* decrease from ID to OD, but makes the height increase because the cross sectional area of the warp bundles is constant. This is another embodiment that results in a helical textile having a substantially constant thickness T3.

Figure 13:
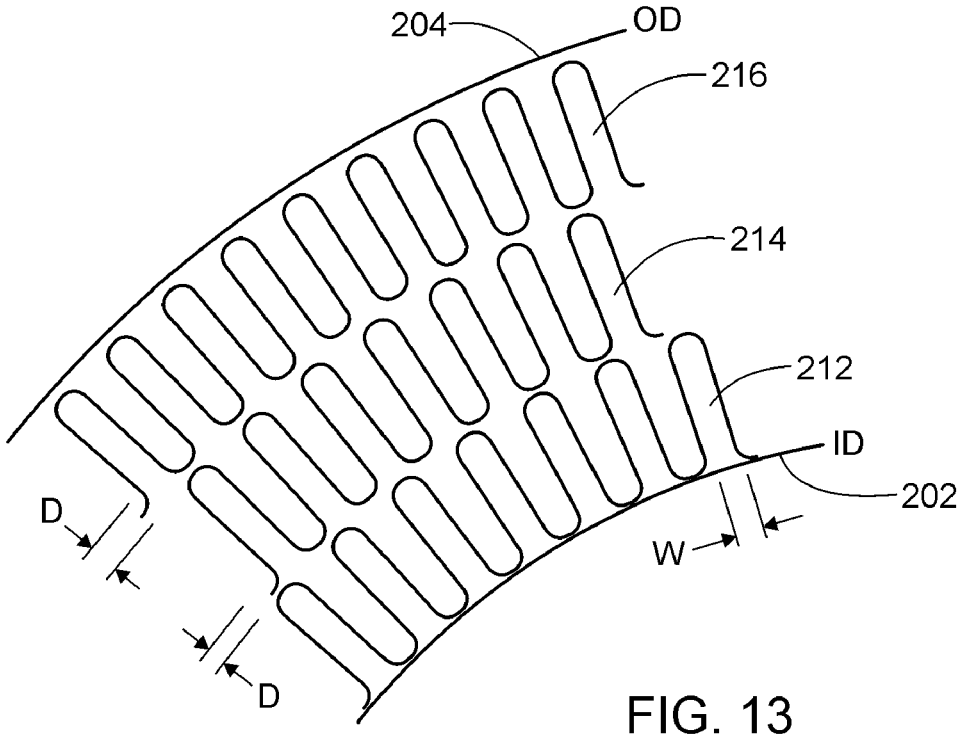
FIG. 13 is a plan view of a weft fiber layer embodiment having three weft fiber bundles at discreet radial distances between the textile ID and OD, and where the spacing between the bundles is constant.
Figure 14:
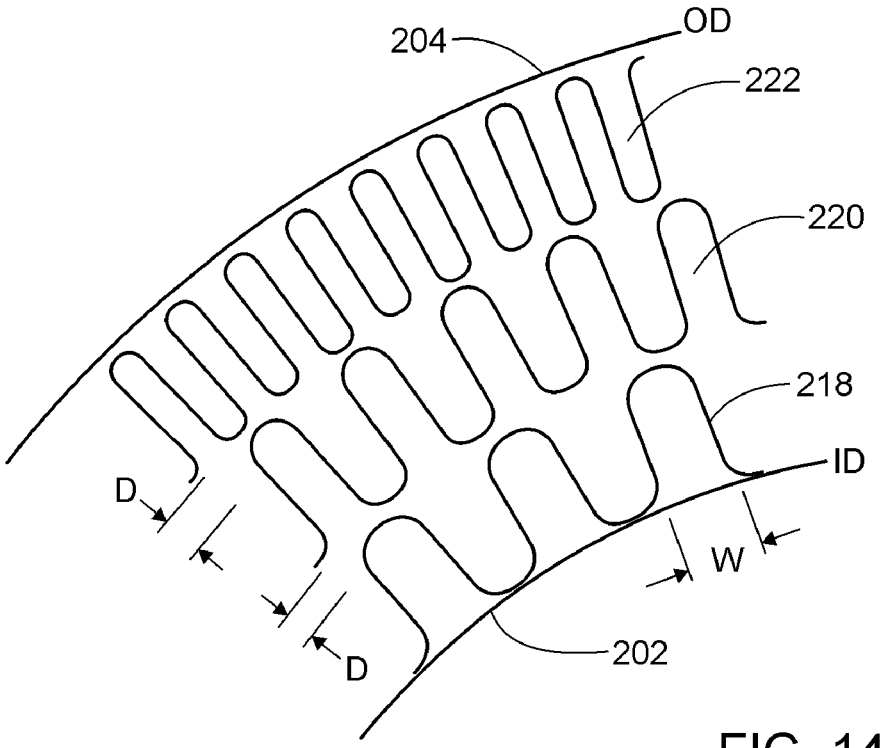
FIG. 14 is a plan view of a weft fiber layer embodiment having three weft fiber bundles at discreet radial distances between the textile ID and OD, and where the spacing between the bundles decreases from OD to ID.

FIG. 13 is a plan view of a weft fiber layer embodiment having three weft fiber bundles 212, 214, 216 at discreet radial distances between the textile ID 202 and OD 204. The radial spacing "w" between the bundles is constant. As used herein, a "bundle" is a continuous fiber or group of fibers that is shown going back in forth in an "S" shape. In this embodiment generally shown in FIGS. 13 and 14, no weft bundles traverse entirely from ID 202 to OD 204. FIGS. 13 and 14 show three bundles, but two or more could be used. In FIG. 14, the bundles are numbered 218, 220, and 222 from ID to OD.

The bundle closest to the OD 216 has a greater concentration of weft yarn than the mid-wall bundle 214, and the mid-wall bundle 214 has a greater concentration than the bundle closest to the ID 212. This can be done in two ways: 1) use the same or similar bundle spacing but use larger yarns in the weft at the OD 216 versus mid-wall 214 versus ID 212, such as that shown in FIG. 13, or 2) turning to FIG. 14, use the same yarn bundle size in each bundle but use a closer bundle spacing "w" at the OD 222 versus mid-wall 220 versus the ID 218.

In FIG. 13 the weft bundles 212, 214, 216 can be separated by a radial distance "D" or they can actually overlap, as design issues dictate. In FIG. 14 the weft bundles 218, 220, 222 can also be separated by a radial distance "D" or they can actually overlap, as design issues dictate.

The benefit of using different yarn denier or filament counts is that one can use stock that is at hand. This can be a great cost savings.

The features shown in FIGS. 13 and 14 can also be used with either or both the warp modification options shown in FIGS. 11 and 12, namely, constant warp yarn spacing from OD to ID but change the yarn bundle size/cross sectional area, or use a constant yarn bundle size from OD to ID but change the spacing between adjacent warp yarn bundles. In other words, spacing is closer as one progresses from ID to OD.

Typical applications of a textile according to the present invention would use multiple layers, i.e. a coil, of helical textile. Another application might cut 360 degree pieces and then stack them to achieve multiple layers, alternating the position of the cut and splice. Other applications would use a continuous length of helical textile without cuts and splices.

The textile can be used to reinforce composite structures, or it could be used as a textile for non-composite applications, such as for a circular gasket. The fiber types that can be used include, without limitation, carbon, graphite, glass, and ceramic.

Although the present invention has been described with reference to particular embodiments, it will be apparent to those skilled in the art that variations and modifications can be substituted therefor without departing from the principles and spirit of the invention.

I claim:

1. A helical textile having a substantially uniform thickness comprising:

uniform radial weft fibers from a textile ID to a textile OD;

non-interlaced circumferential warp fiber bundles having an equal and constant width and having a height that increases from the textile ID to the textile OD; and a plurality of knitted chain stitches at a plurality of warp and weft crossover points, thereby forming a helical textile having a substantially uniform thickness from textile ID to OD.

2. The helical textile of claim 1, wherein the helical textile reinforces a composite structure.

* * * * *